United States Patent [19]

Snyder et al.

[11] Patent Number: 4,942,794

[45] Date of Patent: Jul. 24, 1990

[54] TORQUE TOOL

[75] Inventors: Robert F. Snyder, Hamden; John H. Ferguson, Rockyhill, both of Conn.

[73] Assignee: Raymond Engineering Inc., Middletown, Conn.

[21] Appl. No.: 346,362

[22] Filed: Apr. 27, 1989

Related U.S. Application Data

[63] Continuation of Ser. No. 244,928, Sep. 15, 1988, abandoned.

[51] Int. Cl.[5] ..... B25B 17/00

[52] U.S. Cl. ..... 81/57.22; 81/57.14; 81/57.36

[58] Field of Search ..... 81/56, 57.14, 57.22, 81/57.3, 57.36, 57.42

[56] References Cited

U.S. PATENT DOCUMENTS 3,783,955 1/1974 Gill ..... 81/57.22 X 4,515,043 5/1985 Gray ..... 81/57.22

*Primary Examiner*—James G. Smith

*Attorney, Agent, or Firm*—Fishman, Dionne & Cantor

[57] ABSTRACT

A torquing tool is provided which is adapted to tighten threaded connections located in hard to reach places to precise torque values. The torquing tool comprises a housing having a pair of spaced arms pivotably attached thereto. Each arm include a series of idler gears which terminate at a reversible output gear or drive shaft. The housing includes a gearing mechanism which drives a selector gear. The selector gear pivots between a first position which will actuate the idler gears and output gear in the first arm and a second position which will actuate the idler gears and output gear in a second arm. During use, the output gears of the torquing tool are mounted on a pair of spaced nuts; with the arms being pivoted to adjust for differing bolt centers. Next, a handle extending from the housing is actuated to move the selector gear between the first or second position to acutate the gears in either the first or second arms. The selected nut is then tightened by utilizing the non-selected nut as a reaction element. A known bellows system and torque readout provide the torque value for the nut being tightened. The torque tool of the present invention permits precise tightening of hard to reach nuts, in part, by use of the elongated pivotable arms which provide access to remote bolt locations regardless of the centering distance.

25 Claims, 4 Drawing Sheets

TORQUE TOOL

This is a continuation of co-pending application Ser. No. 244,928 filed on Sept. 15, 1988 abandoned.

BACKGROUND OF THE INVENTION:

This invention relates to the field of torquing tools. More particularly, this invention relates to a geared wrench which is particularly well suited for tightening threaded fasteners to precise torque values when the fasteners are in hard to reach locations.

Many known devices and mechanical apparatuses are subjected to extreme environments and demanding vibration and shock. Such devices typically utilize threaded fasteners. The threaded connections on such devices must often be tightened to very precise torque values. While there are several known torque and geared wrenches which provide accurate torquing to a given nut, such prior art wrenches are typically unable to adequately tighten threaded connection which are located in hard to reach or remote locations. For example, the threaded connections for the forward and aft engine mounts on a Boeing 767 jet airplane are positioned so as to preclude ease of access by known torquing tools of the type that will efficiently and adequately deliver the required torque within an adequate time frame. Nevertheless, due to safety considerations and the severe vibration and shock undergone by the engine mounts, it is essential that precise torque values be applied to the nuts associated with the engine mounts.

SUMMARY OF THE INVENTION

The above-discussed and other drawbacks and deficiencies of the prior art are overcome or alleviated by the torquing tool of the present invention. In accordance with the present invention, a torquing tool is provided which is adapted to tighten threaded connections located in hard to reach places to precise torque values. The present invention is particularly well suited for tightening nuts associated with the engine mounts on certain jet aircraft such as the Boeing 767.

The present invention comprises a housing having a pair of spaced arms pivotably attached thereto. Each arm include a series of idler gears which terminate at a reversible output gear or drive shaft. The housing includes a gearing mechanism which drives a selector gear. The selector gear pivots between a first position which will actuate the idler gears and output gear in the first arm and a second position which will actuate the idler gears and output gear in the second arm.

During use, a socket drive shaft assembly is loaded into each of the female sockets of the output gears. The torquing tool is then mounted on a pair of spaced nuts; with the arms being pivoted to adjust for differing bolt centers. Next, a handle extending from the housing is actuated to move the selector gear between the first or second position to actuate the gears in either the first or second arms. The selected nut is then tightened by utilizing the non-selected nut as a reaction element. A known bellows system and torque readout provide the torque value for the nut being tightened.

The torque tool of the present invention permits precise tightening of hard to reach nuts, in part, by use of the elongated pivotable arms which provide access to remote bolt locations regardless of the centering distance.

The above-discussed and other features and advantages of the present invention will be appreciated and understood by those of ordinary skill in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 2:
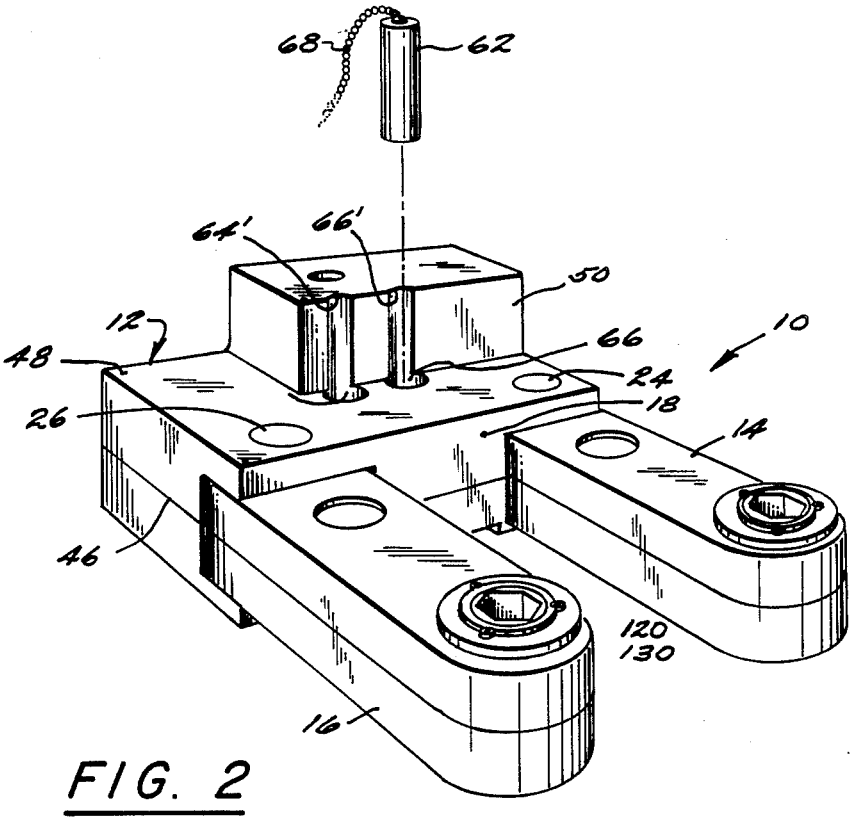
FIG. 2 is a rear perspective view of the torque tool of FIG. 1.
Figure 3:
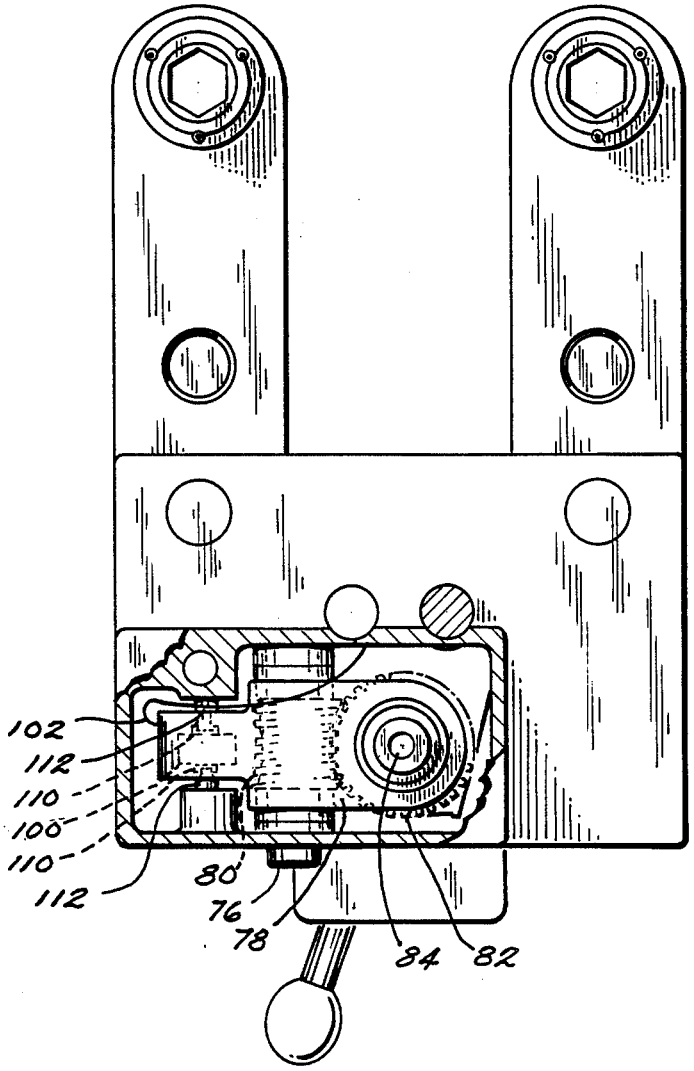
FIG. 3 is a bottom view, partially cut away, of the torque tool of FIG. 1.
Figure 4:
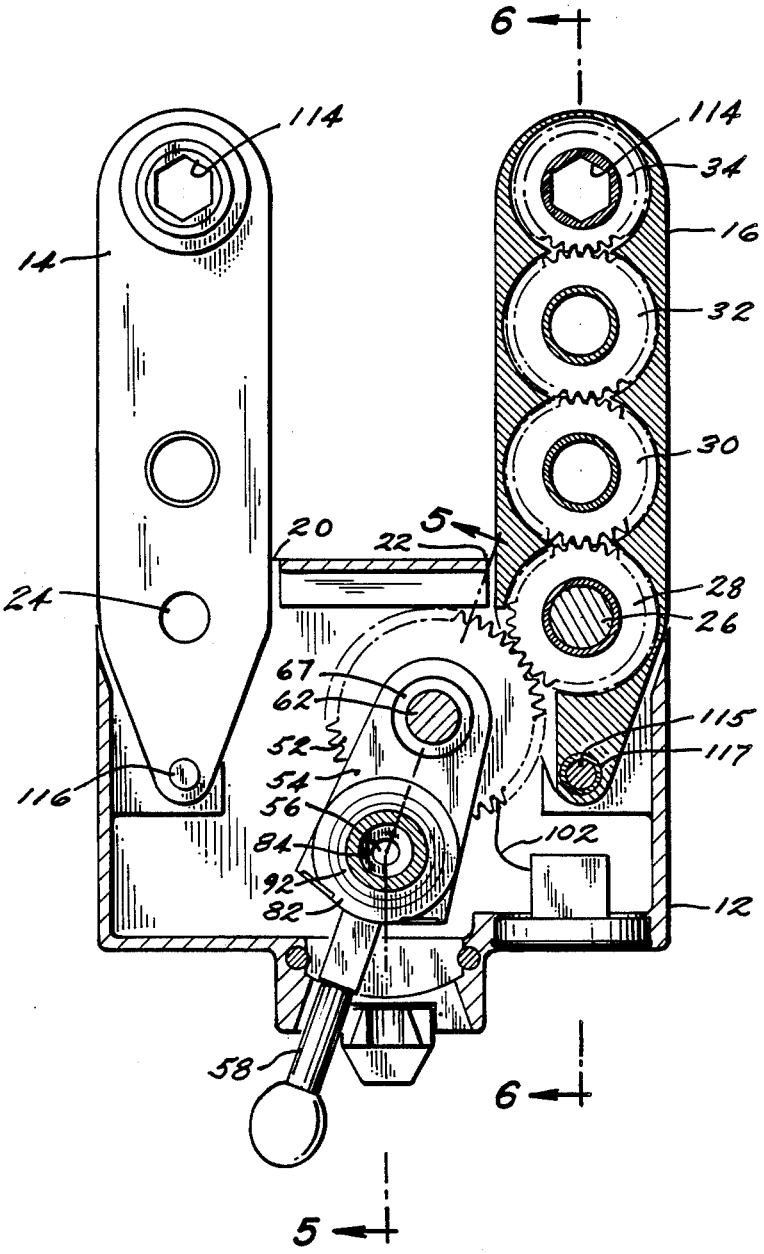
FIG. 4 is a bottom view similar to FIG. 3.

Referring jointly to FIGS. 1–6, a torquing wrench in accordance with the present invention is shown generally at 10. Wrench 10 is comprised generally of a main housing 12 having a pair of spaced arms 14 and 16 pivotably attached thereto and extending from a side surface 18 of housing 12. As shown in FIG. 4, each arm 14 and 16 is positioned through appropriately sized openings 20 and 22 in housing 12 and pivotably connected within the interior of housing 12 by pivot pins 24 and 26. As a result, arms 14, 16 will independently pivot to permit adjustment of the centering distance between a pair of bolts. It will be appreciated that the degree of adjustment will be determined by a pair of stop pins 115, 116 and associated stop pin holes 117. Stop pin holes 117 will have a larger diameter than stop pin 115 and 116. As a result, the larger the opening 117, the larger the degree of adjustability of the arms 14 and 16.

Figure 6:
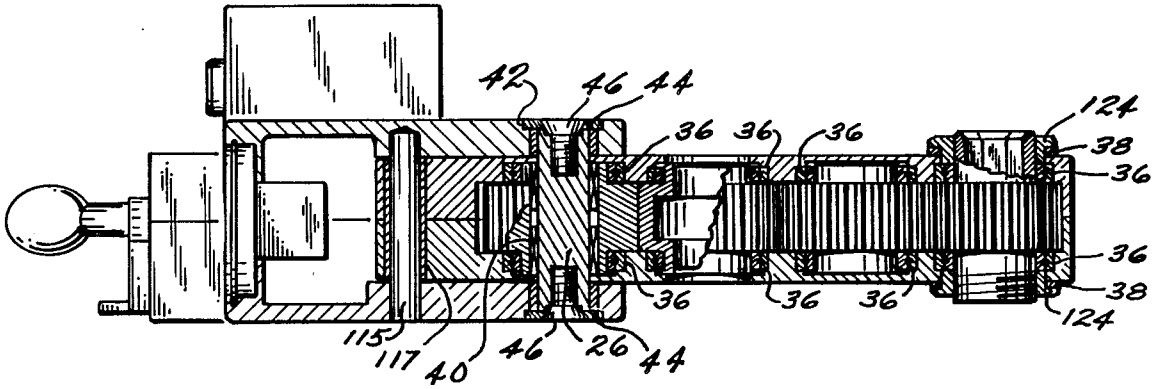
FIG. 6 is a cross sectional elevation view along the line 6—6 of FIG. 4.

Each arm 14 and 16 is preferably comprised of identical two piece housings which mate to form a substantially rectangular enclosure. The interior of each arm includes a series of three intermeshing idler gears 28, 30 and 32 and a reversible output drive shaft or output gear 34. As shown in FIG. 6, idler gears 28, 30, 32 and output gear 34 are mounted in bearings 36 to facilitate rotation and are positioned so that rotation of idler gear 28 will ultimately rotate output gear 34. Output gear 34 also includes a thrust bearing 38 to compensate for bending moments during use. The output drive gear 34 is open on either side at hexagonally shaped female opening 14 to receive pre-selected socket drive shaft assemblies of differing sizes such as the assemblies identified at 118 in FIG. 1. Each socket drive shaft assembly 118 includes a drive shaft 120 which is received by opening 114; and a suitably sized socket portion 122.

Figure 1:
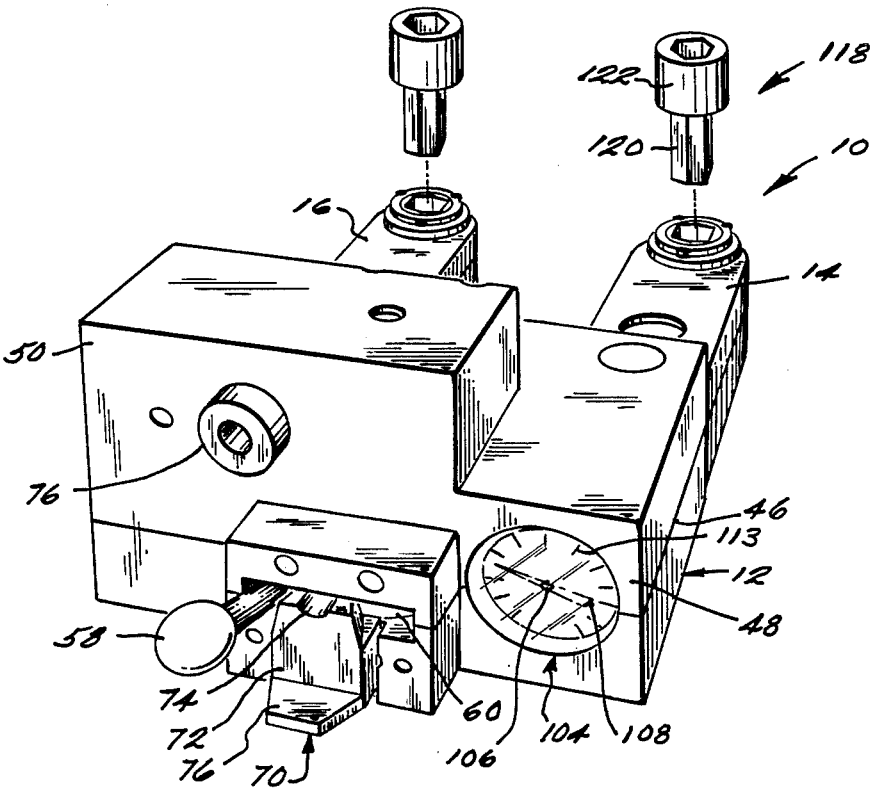
FIG. 1 is a front perspective view of the torque tool of the present invention.

Thrust bearings 38 are held in position by a pair of retaining caps 124 which are threadably received on output drive gear 34. In addition, spaced threaded openings 128 (preferably three) are Provided (as shown in FIGS. 1 and 2) on both retaining caps 124. Openings 128 overlap both retaining caps 4 and output drive gear 34; and set screws 130 are threaded into these openings to insure retention of the retaining caps (and thrust bearings) on drive gear 34 and thereby preclude caps 24 from loosening during use.

Still referring to FIG. 6, each pivot pin 24, 26 is surrounded by a sleeve bearing 40 through the center of idler gear 28. A counter bore 42 is provided to opposed sides of housing 12 and plates 44 are received in the counterbore. Bolts 46 are then threadably received through plates 44 and into pivot pin 26 to thereby retain pivot pin within housing 12.

Figure 5:
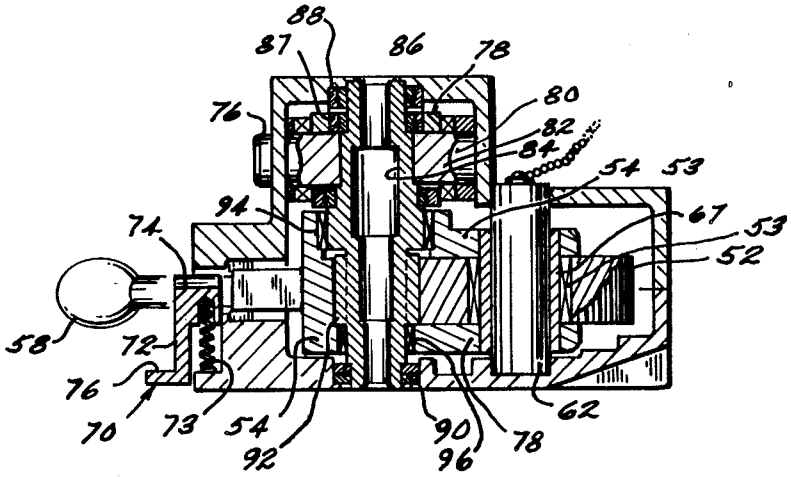
FIG. 5 is a cross sectional elevation view along the line 5—5 of FIG. 4.

Housing 12 is comprised of two pieces which are bolted together along the line shown at 47. Housing 12 includes a lower main housing portion 48 and a smaller upper housing portion 50. Housing portion 48 houses a gearing mechanism as will be described below. As shown in FIGS. 4 and 5, lower housing portion 48 includes a gear selector mechanism consisting of a selector gear 52 pivotably mounted via a bearing 53 on a support 54 which in turn, pivots about a drive shaft 84. Bearing 53 surrounds and rotates about a sleeve 67. A handle 58 is attached to the end of support 54 which is opposite selector gear 52. Handle 58 extends outwardly of housing 12 through a slot 60. By moving handle 58 to left or right, support 54 will pivot selector gear 52 between a first position engaged with idler gear 28 in arm 14 and a second position engaged with idler gear 28 in arm 16 (shown in FIG. 4). As is best seen in FIGS. 2 and 5, selector gear 52 is locked into a desired first or second position by use of a locating pin 62 which is slidably received in either one of two openings 64 and 66 through housing 12; and through sleeve 67 in the center of selector gear 52. Preferably, a semi-cylindrical groove 64' and 66' is provided in upper housing portion 50 to facilitate entry and exit of locating pin 62 in openings 64 and 66. Also, a chain 68 can be attached between locating pin 62 and housing 12 to prevent loss of the pin.

During non-use, selector gear 52 is disengaged from both idler gears 28 and retained therebetween by use of retaining means 70 (see FIGS. 1 and 5) which comprises a member 72 actuated by a spring 73 having a semi-cylindrical groove 74. During non-use, member 72 is pulled downwardly by thumbgrip 76. Handle 58 is aligned with groove 74 and member 72 is allowed to spring back upwardly to hold handle 58 locked in a central position. An important function of the disengaged selector gear 52 is to allow the alignment of the tool onto a pair of nuts to be tightened by permitting rotating of the output shaft 118 until alignment with a desired nut is effected.

Selector gear 52 is actuated by any suitable gearing system. In a preferred embodiment, the gearing system used is substantially similar to the gearing system disclosed is U.S. Pat. No. 4,665,756 assigned to the assignee hereof, all of the contents of which are incorporated herein by reference.

Referring to FIGS. 3–5, this gearing mechanism includes an input drive unit 76 connected to a worm gear within upper housing portion 50, the drive unit 76 having a square socket to receive the tip of a drive crank (not shown). Interiorly of housing 12, the gearing mechanism comprises a carrier element 78. Carrier 78 carries a worm 80 (which has input 76), and carrier 78 also a worm gear 82 which meshes with and is driven by worm 80. Worm 80 and worm gear 82 are designed so that they form a self locking combination (e.g. so as to prevent back driving under load) for inputs of up to 300 foot pounds. As discussed and shown in U.S. Pat. No. 4,665,756, worm 80 is rotatably supported on radial needle bearings, and each end of worm 80 is capped by a thrust nut which is threadably fastened to the end of the worm about the input drive opening and which is rotatably supPorted on thrust roller bearings. The thrust nuts are sealed against oil leakage by seals.

Gear 82 is splined to a drive shaft 84 by a splined connection 86. Drive shaft 84 is rotatably supported in housing 12 by radial/thrust bearings 88 and 90. In addition, drive shaft 84 is rotatably supported in carrier 78 by bearing 87. As shown in FIG. 5, drive shaft 84 is also mounted for rotation in support member 54 by bearings 94 and 96. Drive shaft 84 includes a pinion 92. The teeth of pinion 92 mesh with and drive the teeth on selector gear 52.

Turning to FIG. 3, carrier element 78 also houses a bellows 100 which is filled with hydraulic fluid and is connected via a hydraulic line 102 to gage 104. Bellows 100, hydraulic line 102 and gage 104 function as described in U.S. Pat. No. 3,683,686 (assigned to the assignee hereof and the contents of which are incorporated by reference) to provide a hydraulic measuring system to measure the torque of the wrench. Indicator shaft 106 is connected to gage 104 so that the position of indicator 108 is commensurate with the torque load. The torque load is imposed on bellows 100 by a pair of load buttons 110 which sit in mating depressions on opposite sides of bellows 100. Each of the buttons 110 is at the end of an adjustable screw 112 whereby the bellows may be calibrated or preloaded.

Load buttons 110 are constructed and operate as described in U.S. Pat. No. 4,577,912, assigned to the assignee hereof and incorporated herein by reference.

The torque wrench of the present invention operates as follows. Suitably sized drive shaft assemblies 118 are loaded in a known manner into output gears 34. Next, socket portions 122 are mounted onto spaced threaded elements (e.g. nuts). Arms 14 and 16 are pivoted (by virtue of selector gear 52 being disengaged) to permit this mounting regardless of the centering distance between the spaced nuts. Next, handle 58 is removed from retaining means 70 and moved left or right to engage the gearing in either arm 14 or 16. If it is desired to engage arm 16, handle 58 is moved to the left as in FIG. 4 so that the teeth on selector gear 52 engage the teeth on idler gear 28. Thereafter, locating pin 62 is inserted through opening 66 to retain selector gear 52 in position. At this point, a hand crank is inserted into input 76. Turning crank 76 will sequentially rotate worm 80, worm gear 52 drive shaft 84, pinion 92 and selector gear 52. In turn, selector gear 52 will sequentially rotate idler gear 28, idler gear 30, idler gear 32 and finally output gear 34. Significantly, the desired threaded connector will be tightened by reaction through arm 14 on the stationary second threaded element. This second threaded element can then be tightened by moving selector gear 52 (and locating pin 62) into position engaging idler 28 of arm 14. In this latter case, the first threaded element will act as the reaction element. Preferably, the gear ratio from the worm 80 to the output gear 34 is about 86 to 1.

During all stages of operation, the readout system will provide an accurate indication of the torque load. The torque load results in imposition of an equal and opposite reaction on worm 80 and on carrier 78, whereby carrier 78 and worm 80 pivot slightly relative to housing 12 about the axis of drive shaft 84; and this pivoting action results in a load being imposed on the bellows 100 through one or the other load buttons 100. This load on the bellows is transmitted by hydraulic line 102 to gage 104 where it is then read out by means of indicator 108 and dial 113.

The torque wrench of the present invention thus permits accurate and precise torquing of threaded connections in extremely hard to reach places by virtue of elongated arms 14 and 16 and the associated internal gearing which allows remote input (e.g. at input 76). Of course, the length of arms 14 and 16, and the number of internal idler gears may be varied depending on the application. Accordingly, the use of three idler gears 28, 30 and 32 is shown by way of example only.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A torque wrench comprising:

a housing having an interior and an exterior;

a first arm pivotably mounted in said housing and extending outwardly of said housing;

a second arm pivotably mounted in said housing and extending outwardly of said housing, said first arm being spaced from said second arm;

first gear train means in said first arm and terminating at a first output gear;

second gear train means in said second arm and terminating at a second output gear;

gear selector means at least partially in said housing, said gear selector means actuating either said first gear train means or said second gear train means; and third gear train means in said housing for torque multiplication, said third gear train means having an input means thereto, said input means communicating between said third gear train means and the exterior of said housing, said third gear train means including a rotatable drive shaft communicating and adapted to drive said gear selector means.

2. The device of claim 1 wherein:

said housing includes a first opening and a spaced apart second opening, said first arm extending through said first opening and said second arm extending through said second opening, said first opening being larger than said first arm to permit said first arm to move radially and said second opening being larger than said second arm to permit said second arm to move radially.

3. The device of claim 1 wherein:

said first and second gear train means each include a plurality of rotatable idler gears communicating between said gear selector means and said first or second output gears.

4. The device of claim 1 wherein said gear selector means comprises:

a support member in said housing, said support member being pivotably mounted about said drive shaft; and a selector gear rotatably mounted on said support member and movable with said support member, said selector gear communicating with said first gear train means in a first position and with said second gear train means in a second position.

5. The device of claim 4 further including:

a handle attached to said support member and extending outwardly of said housing through a slot.

6. The device of claim 4 including:

locking means for locking said selector gear in said first or second position.

7. The device of claim 6 wherein said locking means comprises:

first and second spaced apertures through said housing;

a sleeve through the center of said selector gear; and a locating pin adapted to be positioned through either said first or second apertures and through said sleeve.

8. The device of claim 4 including:

retaining means for maintaining said selector gear between said first and second positions.

9. The device of claim 4 wherein:

said drive shaft includes a pinion, said pinion engaging and driving said selector gear.

10. The device of claim 1 including:

thrust bearing means, said first and second output gears being mounted on said thrust bearing means.

11. The device of claim 1 including:

unitary internal carrier support means disposed in said housing, said carrier support means supporting said third gear train means and said torque measuring means.

12. The device of claim 11 wherein said third gear train means comprises:

a first gear means terminating at said input means, said first gear means being rotatably supported on first bearing means; and second gear means which meshes with and is driven by said first gear means, said second gear means being connected to said drive shaft wherein said second gear means drives said drive shaft.

13. The device of claim 12 wherein:

said first gear means comprises a worm.

14. The device of claim 13 wherein:

said worm includes opposed ends, said ends being capped by thrust nut means, said thrust nut means surrounding said input means.

15. The device of claim 14 wherein:

said ends of said worm are rotatably supported on thrust roller bearings.

16. The device of claim 12 wherein:

said first and second gear means form a self locking combination for inputs of up to 300 foot pounds.

17. The device of claim 12 wherein:

said first bearing means comprises radial needle bearings.

18. The device of claim 11 wherein:

said second gear means is splined to said drive shaft.

19. The device of claim 1 wherein:

said rotatable drive shaft is rotatably supported in said housing by radial/thrust bearing means.

20. The device of claim 1 wherein:

said torque measuring means comprises hydraulic torque measuring means.

21. The device of claim 20 wherein said hydraulic torque measuring means includes:

a bellows having a hydraulic fluid therein;

said torque load indicating means being connected to said bellows through a hydraulic fluid line;

a pair of load buttons disposed in mating depressions on opposite sides of said bellows; and adjustable screw means abuting each of said load buttons whereby said bellows may be calibrated or preloaded.

22. The device of claim 23 wherein said torque load indicating means comprises:

gage means; and an indicator shaft connected to said gage means.

23. The device of claim 10 including:

first and second retaining cap means threadably mounted on respective of said first and second output gears to retain said thrust bearing means in position.

24. The device of claim 23 including:

first set screw means interconnecting said first retaining cap means to said first output gear; and second set screw means interconnecting said second retaining cap means to said second output gear.

25. The device of claim 1 further including:

torque measuring means disposed in said housing and adapted to measure the torque on said drive shaft; and torque load indicating means being connected to said torque measuring means.

* * * * *